US007645178B1

(12) United States Patent
Trotto et al.

(10) Patent No.: US 7,645,178 B1
(45) Date of Patent: Jan. 12, 2010

(54) VIRTUAL WORLD TOY DOLL SYSTEM

(76) Inventors: Laureen A. Trotto, 168 Brushy Hill Rd., Newtown, CT (US) 06470; Maureen T. Trotto, 36 Crescent Pl., Monroe, CT (US) 06468; Ross M. Albert, 10 Ridge Rock La., East Norwich, NY (US) 11732; Robert W. Jeffway, Jr., 37 Front St., Leeds, MA (US) 01063

( * ) Notice: Subject to any disclaimer, the term of this patent is extended or adjusted under 35 U.S.C. 154(b) by 427 days.

(21) Appl. No.: 11/311,662

(22) Filed: Dec. 20, 2005

(51) Int. Cl.
*A63H 3/00* (2006.01)

(52) U.S. Cl. ..... 446/268

(58) Field of Classification Search ..... None
See application file for complete search history.

(56) References Cited

U.S. PATENT DOCUMENTS 5,766,077 A * 6/1998 Hongo ..... 463/30
5,853,327 A * 12/1998 Gilboa ..... 463/39
6,290,565 B1 * 9/2001 Galyean III et al. ..... 446/99
6,773,325 B1 * 8/2004 Mawle et al. ..... 446/175
2005/0177428 A1 * 8/2005 Ganz ..... 705/14
2007/0093170 A1 * 4/2007 Zheng ..... 446/268

FOREIGN PATENT DOCUMENTS

JP 2004249057 A * 9/2004

* cited by examiner

*Primary Examiner*—Ronald Laneau
*Assistant Examiner*—Tramar Harper
(74) *Attorney, Agent, or Firm*—Andrew Bodendorf

(57) ABSTRACT

A virtual world toy system includes a physical doll and physical props that may be used in conjunction with a virtual world unit. The virtual world unit provides a portal through which the physical doll may enter and explore a virtual world under a user's guidance and control. The physical doll and props may be played with by a user in the real world; however, the physical doll and props also may be placed into the virtual world unit where they manifest themselves in a virtual world presented by the virtual world unit. Once in the virtual world, the virtual world unit provides a virtual representation of the physical doll and props to a user. In addition, the virtual world unit provides an interface to command, assist, direct, and/or influence the virtual doll's interaction with the virtual world. Two or more virtual world units may be connected together so that multiple users may interact together within the virtual world.

29 Claims, 8 Drawing Sheets

VIRTUAL WORLD TOY DOLL SYSTEM

TECHNICAL FIELD

The following description relates generally to a combination physical and virtual toy system.

BACKGROUND

Toy dolls have played a significant role in lives of many children and adults. Toy dolls have been developed for centuries as sources of education, amusement, and entertainment for children. In recent years, a significant adult market also has formed as collectables have become popular. As new technology develops, toy dolls continue to evolve. Therefore, new methods and technology continue to be developed to supplement and replace traditional toy dolls.

SUMMARY

In one general aspect, a virtual world toy system includes a physical doll and a virtual world unit. The virtual world unit includes a housing; a receptacle to receive the physical doll; a display to present a virtual representation of the physical doll in a virtual world; a processing device to determine that the physical doll is in the doll receptacle and to generate the virtual representation on the display in response to the determination. The processor may be configured to present via the display a virtual world that may be navigated by the virtual representation of the doll.

The system also may include one or more physical props for use with the toy system where the virtual world unit includes a prop receptacle to receive the one or more physical props, the processing device is configured to determine a physical prop in the prop receptacle and to generate a virtual representation the determined prop on the display.

The virtual world unit also may include a detection device to detect the physical doll in the doll receptacle and/or to detect the physical prop in the prop receptacle.

The display screen may be positioned substantially in a first plane and the doll receptacle is substantially in a second plane that is substantially parallel to the first plane and the receptacle is configured to move in and out of the housing along the second plane, and the display is positioned adjacent to the doll receptacle and blocks from a users view of a portion of the doll and an interior portion of the doll receptacle that is inside the housing, and the processor is configured to present a virtual representation of the portion of the doll that is blocked on the display.

The physical doll may include an identification device configured to be read by the virtual world unit to identify the physical doll and the processor is configured to generate a virtual representation of the physical doll based on the identification. The physical doll also may include a memory to store data about its corresponding virtual representation's interaction with the virtual world and/or the physical doll's interaction with the virtual world.

The vial world unit may include a memory to store a virtual world application that is used by the processing device to present the virtual world. The memory also may store data about the virtual representation's interaction with the virtual world and/or the physical doll's interaction with the virtual world unit.

The virtual world unit may include a user interface to provide signals to the processing device to navigate the virtual representation of the doll within the virtual world. The virtual world unit also may include an interface to connect to another virtual world unit.

The processor may be configured to present a game to a user using the display that be played in conjunction with the virtual representation of the doll.

In another general aspect, a virtual world unit includes a housing; a receptacle to receive a physical doll; a display to present a virtual representation of the physical doll in a virtual world; a processing device to determine that the physical doll is in the doll receptacle and to generate the virtual representation on the display in response to the determination. The processor may be configured to present via the display a virtual world that may be navigated by the virtual representation of the doll. The virtual world unit also may include a prop receptacle to receive one or more physical props wherein the processing device is configured to determine a physical prop in the prop receptacle and to generate a virtual representation the determined prop on the display. The virtual world unit also may include a detection device to detect a physical doll in the doll receptacle and/or a physical prop in the prop receptacle.

The display screen may be positioned substantially in a first plane and the doll receptacle is substantially in a second plane that is substantially parallel to the first plane and the receptacle is configured to move in and out of the housing along the second plane, and the display is positioned adjacent to the doll receptacle and blocks from a users view of a portion of the doll and an interior portion of the doll receptacle that is inside the housing, and the processor is configured to present a virtual representation of the portion of the doll that is blocked on the display.

The detection device may be configured to read an identification device of the physical doll device to identify the physical doll and the processor may be configured to generate a virtual representation of the physical doll based on the identification.

The processor may be configured to provide data to a memory of the physical doll to store data about its corresponding virtual representation's interaction with the virtual world.

The virtual world unit also may include a memory to store a virtual world application that is used by the processing device to present the virtual world, data about the virtual representation's interaction with the virtual world, and/or data about the physical doll's interaction with the virtual world unit.

The virtual world unit may include a user interface to provide signals to the processing device to navigate the virtual representation of the doll within the virtual world. The virtual world unit also may include an interface to connect to another virtual world unit.

The processor may be configured to present a game to a user using the display that be played in conjunction with the virtual representation of the doll.

In another general aspect, a virtual world unit includes a housing; a receptacle to receive a physical doll; a processing device to determine that the physical doll is in the doll receptacle and to generate a virtual representation signal of the physical doll for display in response to the determination. The virtual world unit also may include an output to provide the virtual representation signal to a display device for presentation to a user.

In another general aspect, a physical doll for use with a virtual world unit includes a body, an interface to receive data from and transmit data to a processor of a virtual world unit regarding the physical doll to present a virtual representation of the physical doll on a display; and a memory for storing the data. The doll also may include an identification configured to be read by a detection device of the virtual world unit to identify the doll to a processor of the virtual world unit. The interface may be a wireless interface or a serial interface.

Other features will be apparent from the description, the drawings, and the claims.

DESCRIPTION OF DRAWINGS

Like reference symbols in the various drawings indicate like elements.

DETAILED DESCRIPTION

Figure 1:
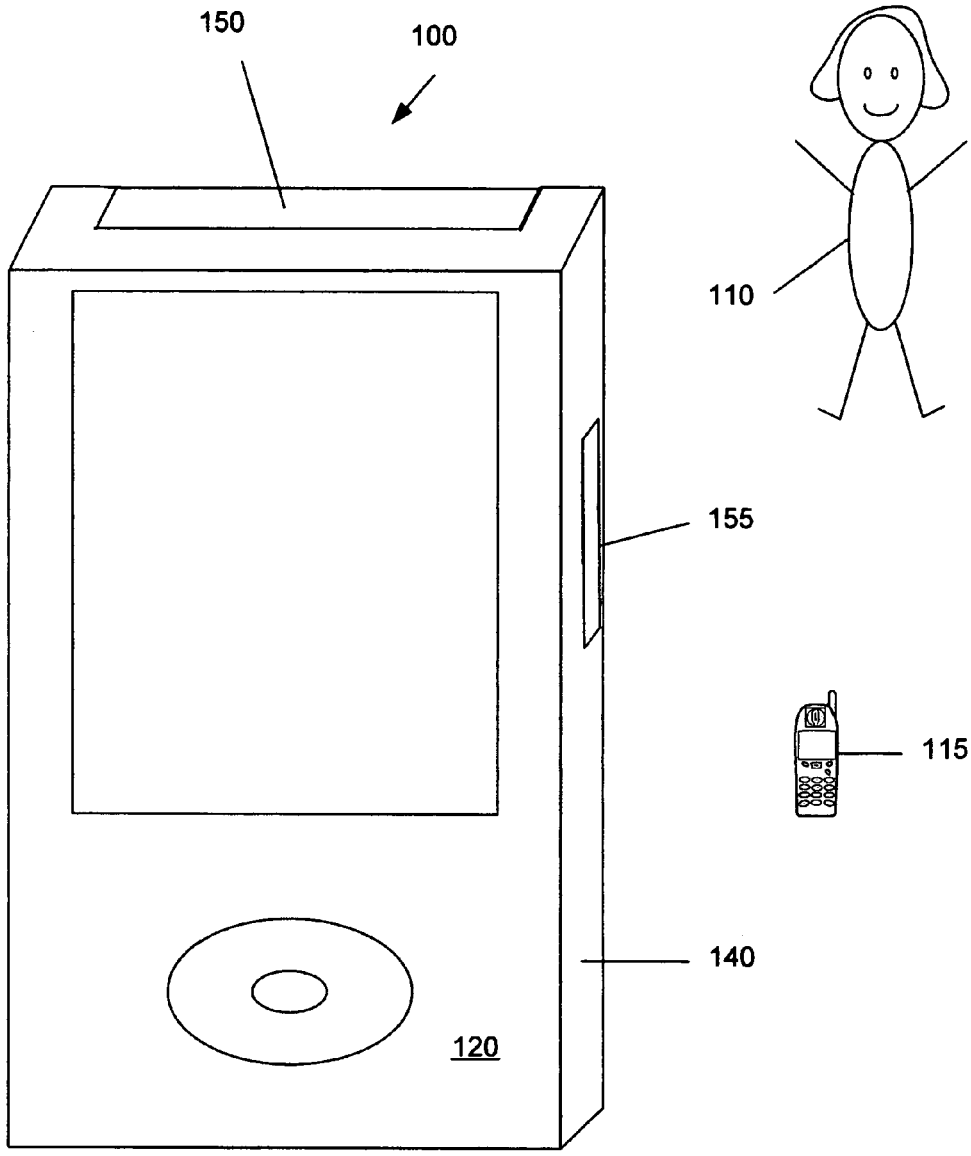
FIG. 1 is an exemplary virtual world toy system.

The following description is directed to a virtual world toy system. As shown in FIG. 1, the virtual world toy system 100 includes a physical doll 110 and physical props 115 that may be used in conjunction with a virtual world unit 120. The virtual world unit 120 provides a portal through which the physical doll may enter and explore a virtual world under a user's guidance and control. The physical doll 110 and props 115 may be played with by a user in the real world. However, the physical doll 110 and props 115 also may be placed into the virtual world unit 120 where they manifest themselves in a virtual world presented by the virtual world unit 120. Once in the virtual world, the virtual world unit 120 provides a virtual representation of the physical doll 110 and props to a user. In addition, the virtual world unit 120 provides an interface to command, assist, direct, and/or influence the virtual doll's interaction with the virtual world. For example, the virtual doll may explore the virtual world, play games, and engage in other activities. Two or more virtual world units 120 may be connected together so that multiple users may interact together within the virtual world. The physical doll 110 and props 115 may be removed from the virtual world unit 120 and played with in the real world. The physical doll 110 and props 115 may renter the virtual world at any time and the virtual world system 100 may be configured to remember the virtual doll's past interaction with the virtual world. Various implementations, embodiments, and examples of the virtual world system 100 are described in further detail below.

In one example, the virtual world system 100 may include a physical doll 110, various physical props 115, one or more virtual world units 120 and peripheral devices. The virtual world unit 120 may be implemented using a hand held or a portable unit. As shown in FIG. 1, the virtual world unit 120 may include a housing 130 with one or more receptacles 135 to receive the physical doll 110 and the props 115, such as, for example, accessed by a physical doll port 150 and a prop port 155. The receptacles may be implemented, for example, a slot, a sliding or swinging drawer or compartment, which may include a door or other cover to secure the physical doll 110 or props 115 within the receptacle. In addition, a receptacle may be provided to store the physical props when not in use.

Figure 2:
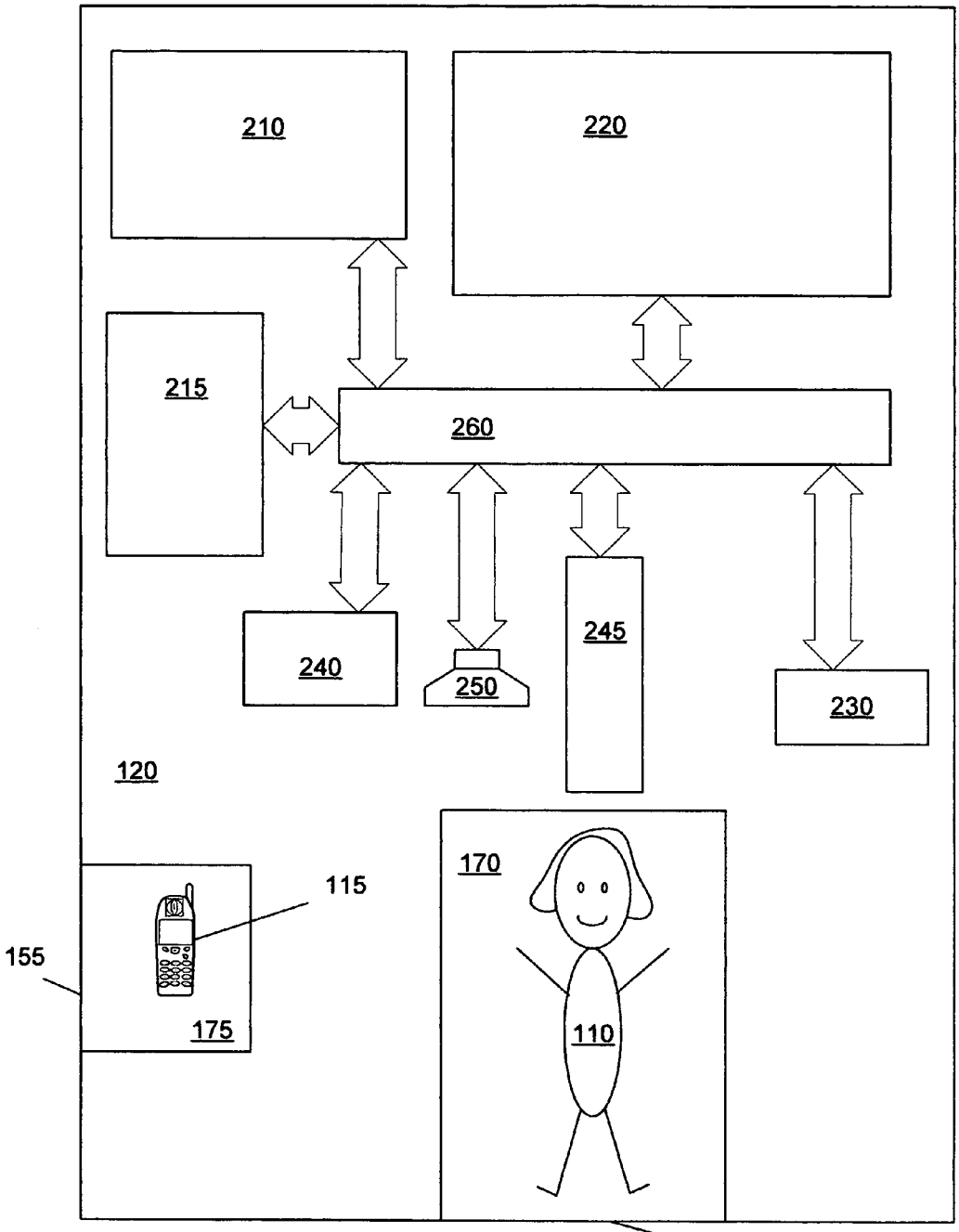
FIG. 2 is an exemplary bock diagram of the virtual world system of FIG. 1.

As shown in FIG. 2, the virtual world unit 120 also may include a processing device 210, a memory 215, and a display 220. Other components also may be included, such as, for example, an I/O interface 230, a user interface 240, a detection device 245, a speaker 250, a communications device or bus 260, a physical doll receptacle 270, and a prop receptacle 275. These components may be incorporated in a single device, for example, as shown in FIG. 2, or several one or more components may be provided as separate devices, such as, for example, peripheral devices.

The processing device 210 may be implemented using a general-purpose or a special purpose computer, such as, for example, a processor, a digital signal processor (DSP), a microcomputer, or a microprocessor capable of responding to and executing instructions in a defined manner. The processing device 210 may run one or more software applications including an virtual world interface application to command and direct the processing device 210 to present a virtual world and virtual doll to the user. The software applications may include a computer program, a piece of code, an instruction, or some combination thereof, for independently or collectively instructing the processing device 210 to operate as desired. The processor also may access, store, manipulate, and create data in response to the applications.

The applications and data may be embodied permanently or temporarily in any type of machine, component, physical or virtual equipment, storage medium, or propagated signal wave capable of providing instructions to or being interpreted by the processing device 210. In particular, the applications or data may be stored by a storage medium or a memory 215 including volatile and non-volatile memories (e.g., a read only memory (ROM), a random access memory (RAM), a flash memory, a floppy disk, a hard disk, a compact disk, a tape, a DROM, a flip-flop, a register, an SRAM, DRAM, PROM, EPROM, OPTROM, EEPROM, NOVRAM, or RAMBUS), such that if the memory 215 is read or accessed by the processing device 210, the specified steps, processes, and/or instructions are performed. The memory 215 or virtual world unit 120 may include an I/O interface 230, such that data and applications may be loaded and stored in the memory 215 allowing the applications, programming, and data to be updated, changed, or augmented, for example, providing new games, challenges, scenarios, props, terrain, maps, or virtual worlds. The memory 215 may be removable, such as, for example, a card, a stick, or a disk that is inserted in or removed from the virtual world unit 120.

The I/O interface 230 may be provided to exchange data with the components of the virtual world unit 120 using various communications paths 280. The interface may be implemented as part of the processing device 210 or separately to allow the processing device 210 to communicate with other devices, such as, for example, a memory device, a server, a networks, the Internet, a mobile phone, a personal data assistant (PDA), a digital tablet/pad computer, a hand held computer, a game system, a personal computer, a notebook computer, a client device, and a work station. The interface 230 may include two or more interfaces, including interfaces for different types of hardware and for different types of communications media and protocols to translate information into a format that may be used by the processing device 210. In one example, the interface may be a USB interface. Similarly, the interface 230 may translate data/information received from the processing device 210 to a format that may be transmitted to other devices via a communications path 280. The interface allows the processing device 210 to send and receive information using the communications paths 280.

The communications paths may be configured to send and receive signals (e.g., electrical, electromagnetic, or optical) that convey or carry data streams representing various types of analog and/or digital data. For example, the communications paths 280 may be implemented using various communications media and one or more networks comprising one or more network devices (e.g., servers, routers, switches, hubs, repeaters, and storage devices). The one or more networks may include a LAN, a WAN, a plain old telephone service (POTS) network, a digital subscriber line (DSL) network, an integrated services digital network (ISDN), a synchronous optical network (SONNET), or a combination of two or more of these networks. In addition, the communications paths 280 may include one or more wireless links (e.g., cellular, mobile, GSM, TDMA, and satellite) that transmit and receive electromagnetic signals, such as, for example, radio, infrared, and microwave signals, to convey information.

Figure 3:
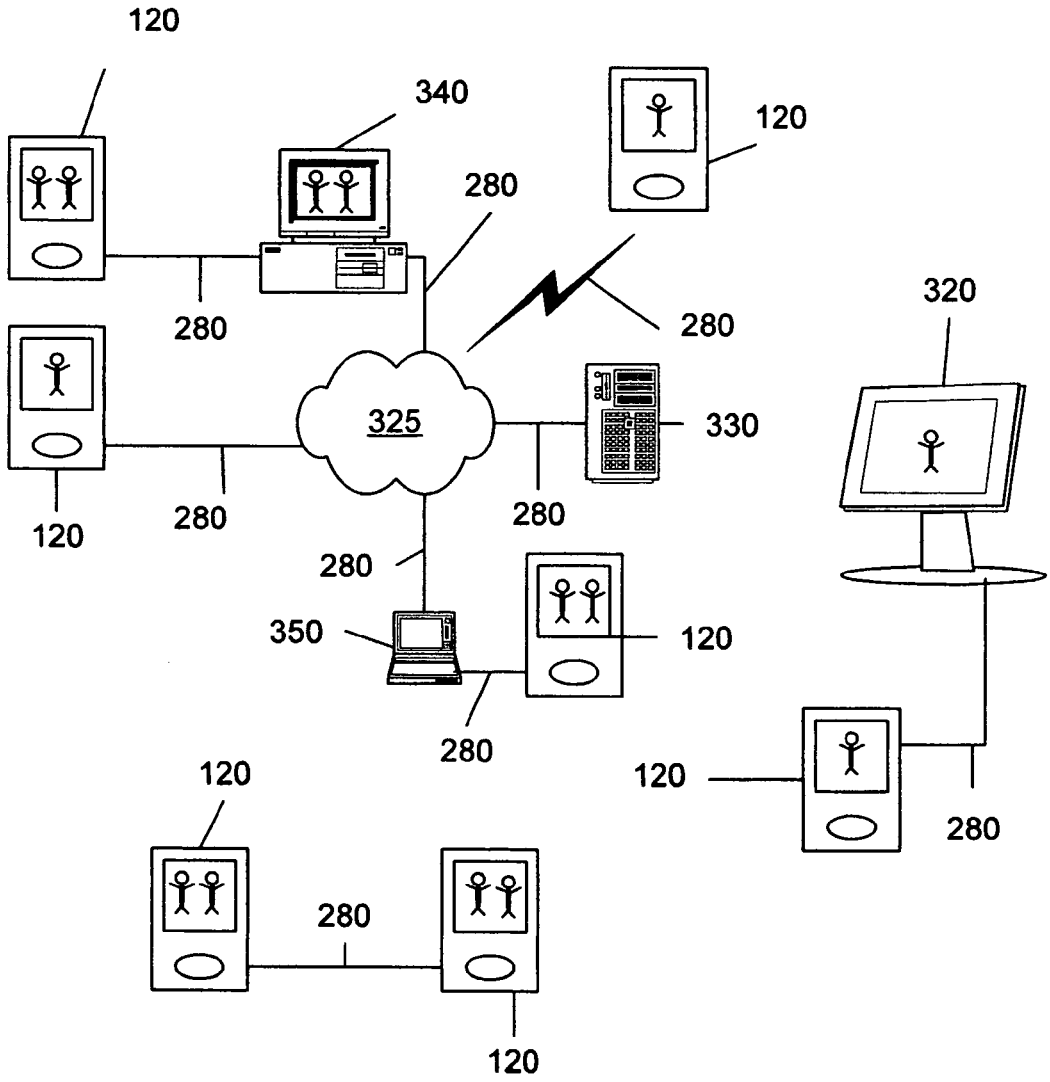
FIG. 3 is an exemplary block diagram of the interconnectivity of the virtual world system of FIG. 1.

FIG. 3 illustrates several examples of possible interconnections using communications paths 280 between devices. For example, two or more virtual world units 120 may be linked together using the I/O interface 230 to exchange information and/or data. For example, information about a virtual world or a doll's interaction with the virtual world may be exchanged with another virtual world unit 120. This allows a doll's history or interaction with the virtual world to be recognized by other virtual world units 120 and devices. In addition, when two or more virtual world units 120 are connected, the users may interact together in their adventure, exploration, or games conducted within the virtual world. In this implementation, the processing devices 210 exchange data to present a single consistent virtual world to the connected users. The I/O interface 230 also may be used to link the virtual world unit 120 to other devices, such as, for example, a display device 320, such as a television, a monitor, an LED display, an LCD display, a plasma display, a DLP display, a projection display, and/or another processing device to present the virtual world to the user. In addition, virtual world units 120 may be linked over distances when using the communications paths 310, such as, for example, including a network 325, to exchange data or download new programming to the memory 215. In one implementation, the virtual world unit 120 may include a microbrowser application to present content (e.g., HTML and XML pages) from the Internet received from a content provider 330. In addition, the virtual world unit 120 may connect with a device, such as, a personal computer 340 or a laptop computer 350. Furthermore, these devices may communicate with each other using communications paths 280 including the network 325.

Figure 4:
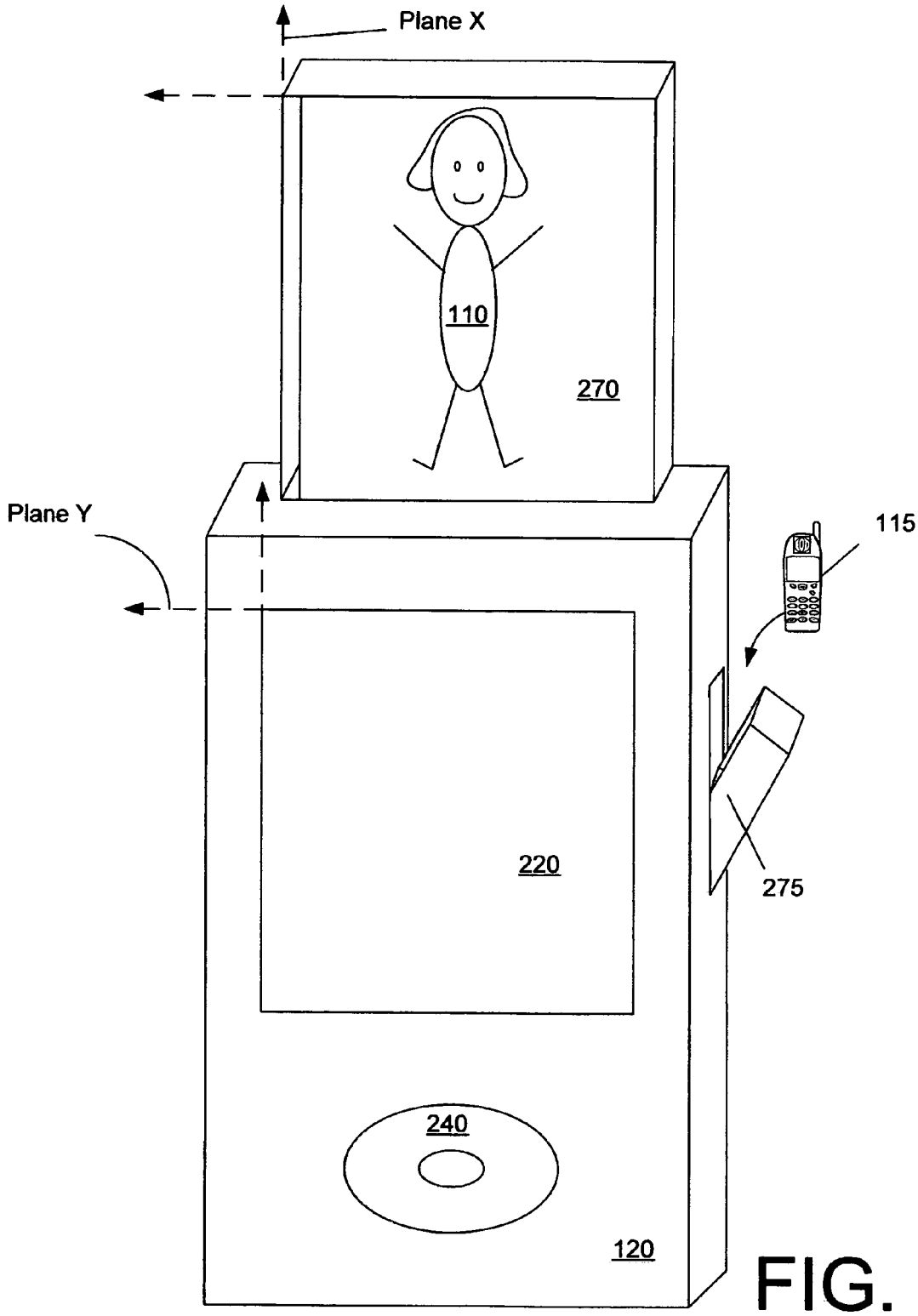
FIGS. 4-6 are exemplary depictions of the physical doll insertion and virtual doll representation display correlation.
Figure 5:
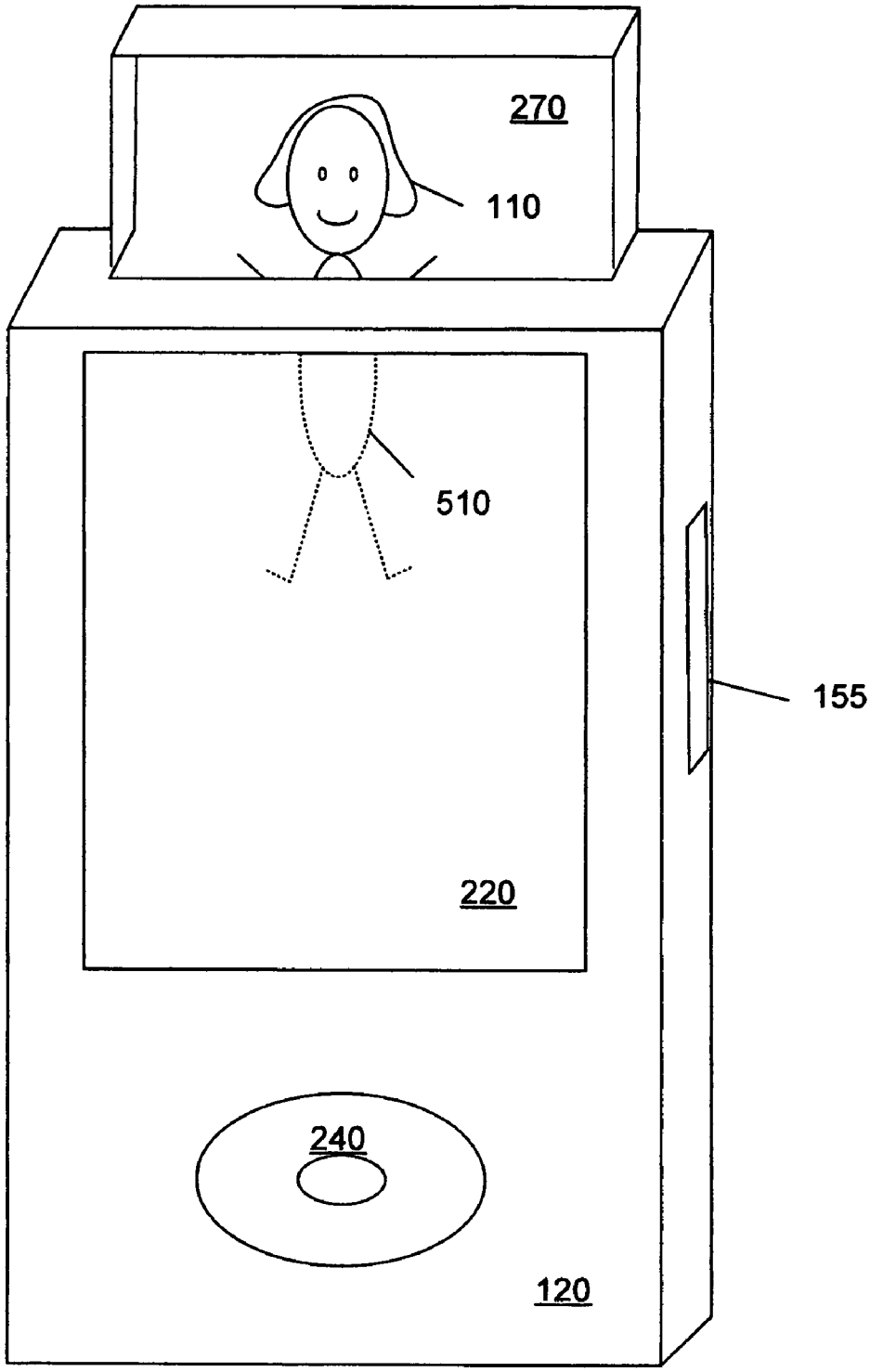
Figure 6:
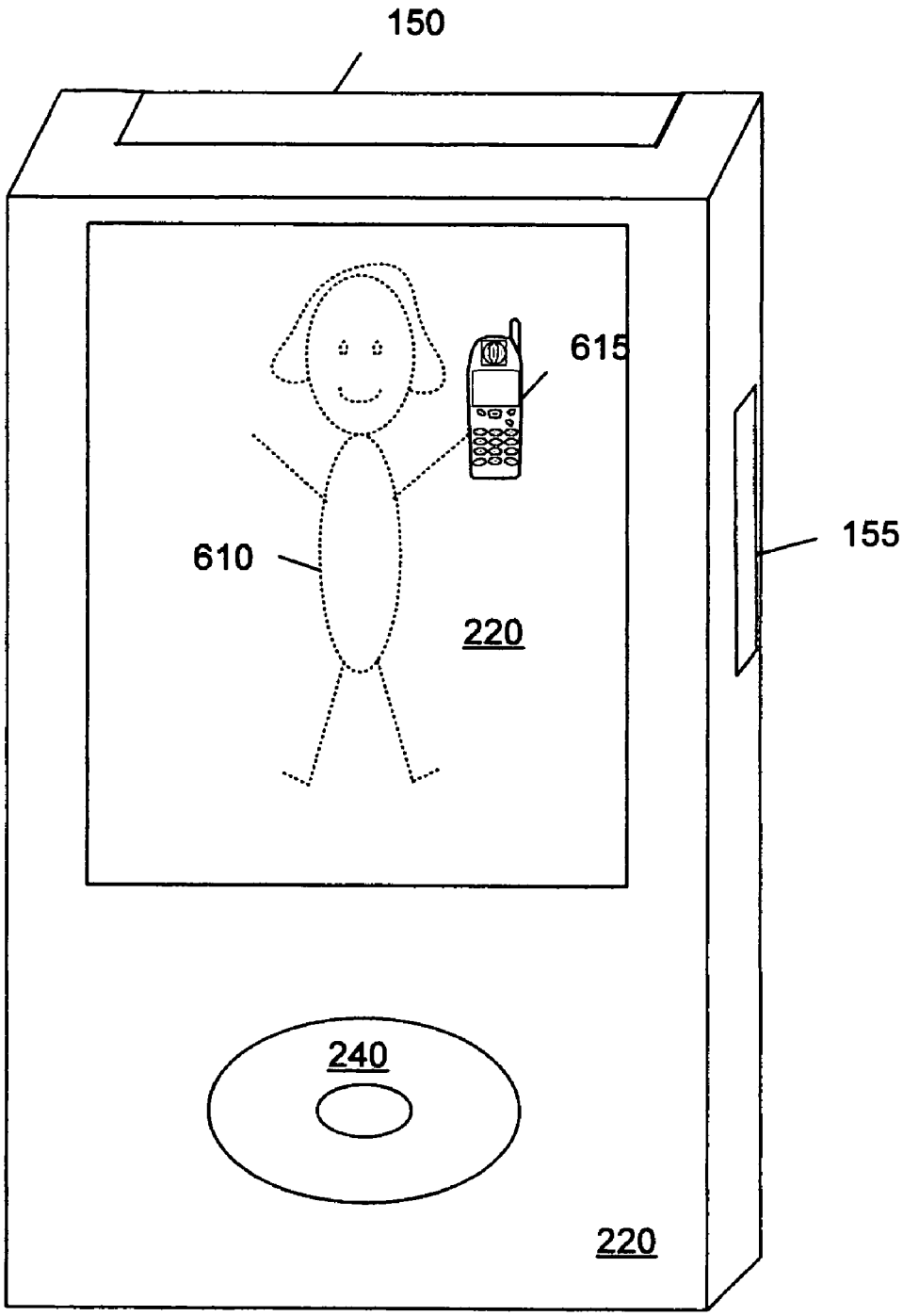

The display 220 may include one or more devices including an LED, an LCD, a micro display, or a touch screen display. The display 220 may be used to present the virtual world and the virtual doll's interaction with the virtual world to the user. In one embodiment, the display 220 is configured to coordinate the virtual doll with the display the physical doll 110 entering the virtual world unit 120, as shown in FIGS. 4-6. For example, once the physical doll 110 is inserted or placed into the doll receptacle 270 (as shown in FIG. 4) and the doll receptacle 270 is closed (as shown in FIG. 6), a virtual representation 610 of the doll (i.e., a virtual doll) in the virtual world is presented on the display 220. In one embodiment, the doll receptacle 270 may be a drawer that slides in and out of the housing 130 of the virtual world unit 120 substantially along a plane X. The display 220 resides in a second plane Y where the planes X and Y are substantially parallel. The doll receptacle 270 may be positioned approximately adjacent to the display 220 such that as the doll receptacle 270 is closed or placed within the housing 130 along plane X, the view of the doll receptacle 270 is blocked by the display 220. As the doll receptacle 270 is closed and the user's view of the physical doll 110 is obstructed by the display 220 and housing, a virtual representation 510 corresponding to the portion of the physical doll's body that is blocked by the display 220 appears. Once the doll receptacle 270 is closed and the entire physical doll 110 is inside the virtual world unit housing 130, a virtual representation 610 of the entire physical doll 110 appears on the display 220 inside the virtual world. Similarly, as the doll receptacle 270 is opened, the virtual representation of the portion of the physical doll's body that is blocked by the display 220 appears until the entire physical doll 110's body is extracted, at which time the display 220 may be deactivated. In addition, physical props 115, such as, for example, a cell phone, a camera, a telescope, binoculars, and a net may be inserted into the virtual world unit 120 through a the prop port 155 into the prop receptacle 275. As a physical prop 115 is inserted into the virtual world unit 120 via the prop port 115, a corresponding virtual prop 615 appears in the virtual world for use by the virtual doll 610. Similarly, when a physical prop 115 is extracted or removed from the virtual world unit 120, the virtual prop 615 disappears from the display 220.

The user interface 240 provides one or more input devices, such as, for example, keys, buttons, switches, knobs, and levers, in addition to keypads, keyboards, touch pads, mice, and touch screens that allow the user to interact with the virtual world unit 120 and virtual world unit 120 interface application. For example, the user may activate a power source to provide power to the components or wake the virtual world unit 120 from a sleep mode. The user interface 240 also may cause the virtual doll to interact with the virtual world. User interaction with the virtual world unit 120 is described in further detail below.

The detection device 245 may be used to detect and identify the physical doll 110 and/or physical props 115 that are inserted inside the housing of the virtual world unit 120, for example, using the doll port 150 and prop port 155. Any number of electronic identification/detector/sensor options may be used, for example, transceiver/antennas, infrared emitter/sensors, optical scanners/readers, and electrical contacts or current readers may be used to detect, sense, or identify the presence of a particular physical doll 110 or prop 115 in the receptacle (270 or 275). In another example, an additional sensor or switch may be placed on the drawer to identify the position of the drawer relative to the display 220 to coordinate the virtual representation of the physical doll 110 and the virtual world on the display 220. Once the physical doll 110 or prop 115 is detected, the detector signals the processor with data, for example, identifying the doll and/or the prop so that the processor may take appropriate action (e.g., display 220 a virtual representation of the doll or prop on the display 220).

The speaker 250 may be used to provide audio data to a user, such as, for example, sound effects, recordings, instructions, dialog, and music to enhance the virtual world unit interface and user interaction with the virtual world. The audio data may be synchronized to occur with or in response to the virtual doll's interaction with the virtual world and/or user.

The communications device or bus 260 may be used to exchange data between the various components of the virtual world unit 120 and/or a peripheral device.

The virtual world unit 120 also may include one or more power sources (e.g., a primary and a backup power source) to provide power to one or more components of the virtual world unit 120. The power source may be AC and/or DC. The power source may be internal or external and replaceable (e.g., one or more batteries or rechargeable batteries). In one implementation, the processing device 210 may provide a timeout feature which places the device in a standby, sleep, or off mode to conserve power when the virtual world unit 120 is not in use.

The physical doll 110 may take the form of a humanoid, a creature, or other lifelike object (real or imaginary). The physical doll 110, for example, may be an action figure, a hero, a monster, or an animal. The physical doll 110 may include an active or passive identification device that may be interpreted by the virtual world unit 120. For example, the physical doll 110 may include a transponder, an RFID, a barcode or other optically sensed ID, a contact ID, or one or more resistors that may be read by the detector of the virtual world unit 120 to identify the doll.

Figure 7:
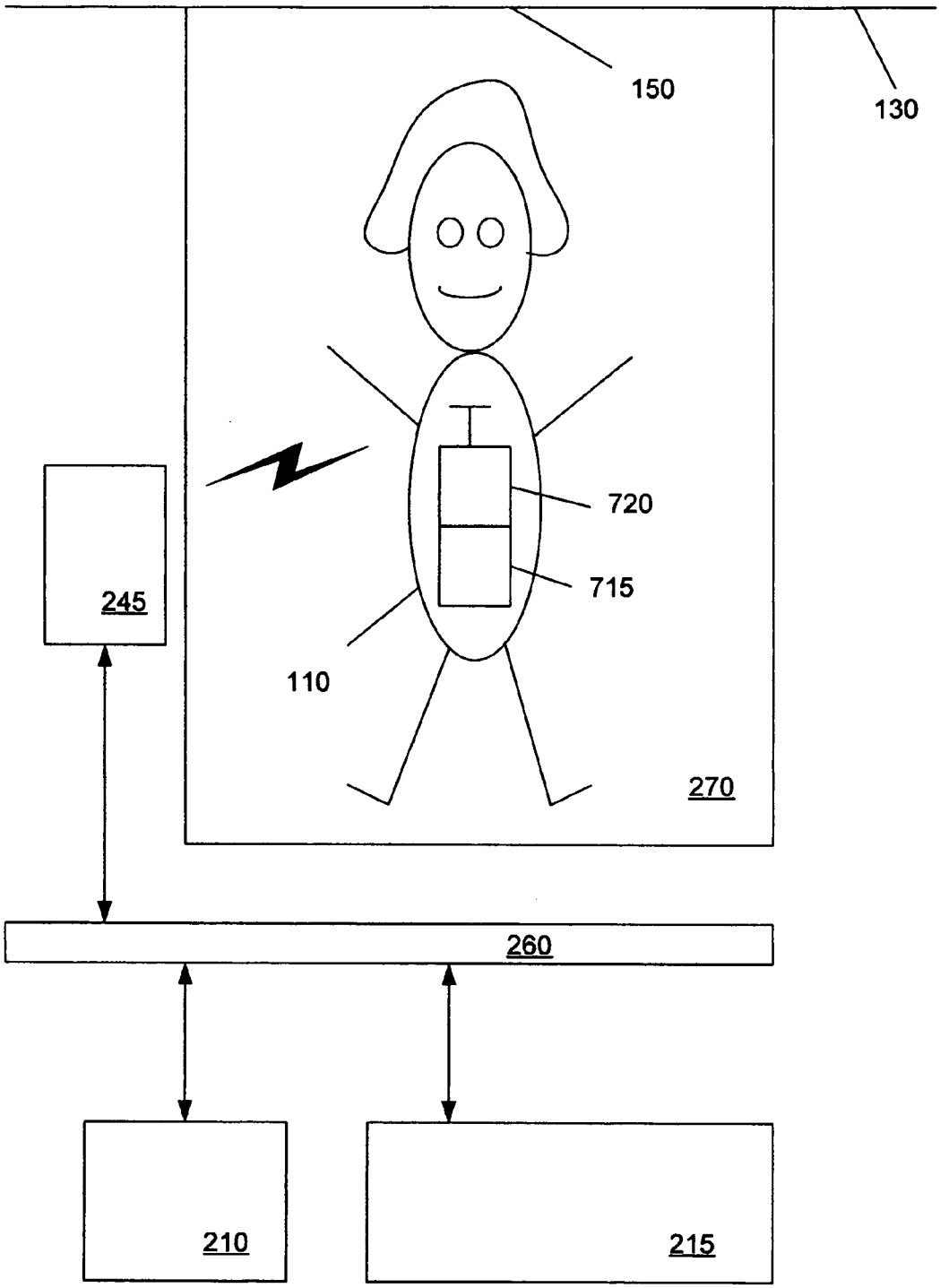
FIG. 7 is a block diagram of a partial virtual world unit and physical doll.

As shown in FIG. 7, the physical doll 110 also may include a memory device 715 (e.g., such as those described above for memory device 215) that may be accessed by the virtual world unit 120. For example, the memory device 715 also may be read by the processing device 210 and used to identify the physical doll 110 and/or supply data to the virtual world application. In addition, data may be stored in the doll's memory device 715 that corresponds to the physical doll 110, such as data regarding the virtual doll's past interaction with the virtual world. For example, as the virtual doll 610 interacts with the virtual world, the memory 715 device of the physical doll 110 may store data corresponding to the interaction. As a result, a history of the virtual doll 610 may be developed over one or more sessions or use of the virtual world unit 120. Each time the physical doll 110 is inserted into a virtual world unit 120, the processing device 110 may provide a virtual world and virtual doll 610 that is consistent with the doll's past use and/or experiences. In addition, if the physical doll 110 is placed in different virtual world units 120 (e.g., a virtual world unit of another, such as friend), the virtual doll's past experiences stored in the physical doll's memory 715 may be used and the virtual world appear consistent to the user. In addition, the physical doll's new experiences may be saved in the physical doll's memory 715 As previously describe, the virtual doll's experiences also may be saved in the memory 215 of the virtual world unit 120.

The memory device 715 may be accessed by the detection device 245 such as a transceiver interrogating a transponder 720 connected as an interface to the memory 715. Of course other means may be used to read the memory such as a contact connection on the doll that connects to a serial port of the virtual world unit 120. In this example, the physical doll 110 is connected to the port when then inserted in the doll receptacle 270.

Figure 8:
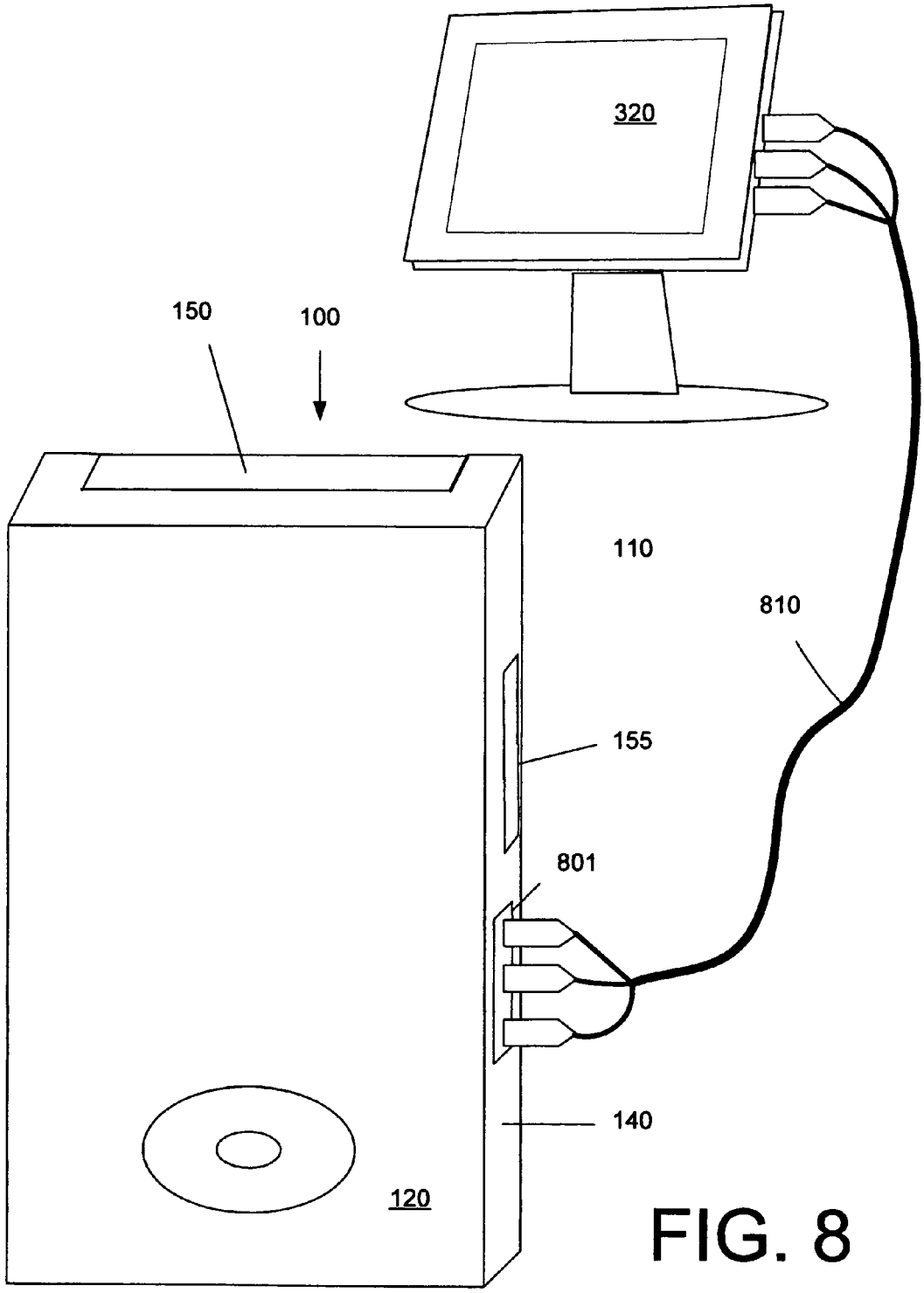
FIG. 8 is an exemplary block diagram of a virtual world unit connected to a display device.

FIG. 8 shows another implementation of the virtual world unit 120. In this example, the virtual world unit 120 does not include a display 220; however, the virtual world unit 120 may be connected to a display device 320, such as, for example, a CRT display, an LED display, an LCD display, a plasma display, a LCoS display, or a DLP display to present the virtual world and virtual representation to the user. The virtual world unit 120 may include an I/O port 801 for connection to the display device 320, such as, for example, RCA, S-video, component video, RGB, firewire, or DVI connection. A cable 810 may be used to connect the virtual world unit 120 to the display device 320. Once connected, the virtual world unit 120 outputs audio/video signals corresponding to the virtual world and virtual representation for presentation on the display device 320.

The display 220 of the virtual world unit 120 is the user's portal into the virtual world. The display 220 is configured to display 220 a virtual representation of the doll (i.e., the virtual doll) and virtual props 615. In one example, as the physical doll 110 is inserted in the virtual world unit 120, the screen may be activated to show a virtual representation or virtual doll 610. As described above, the portion of the physical doll 110 inserted into the virtual world unit 120 may correspond to the portion of the doll that is presented on the display 220. Once the physical doll 110 is entirely inserted, the virtual doll 610 may explore and/or interact with the virtual world. For example, the virtual doll 610 may traverse a virtual landscape or play games. In addition, physical props 115 may be inserted to produce virtual props 615 for use with the virtual world unit 120 during the virtual doll's interaction with the virtual world.

Once in the virtual world, the virtual doll may go on an adventure and traverse the virtual world. The user may cause the virtual doll to interact with the virtual world. The virtual doll may navigate a virtual terrain, such as a jungle, a desert, a mountain, an ocean, a city, or a forest. The user may guide the virtual doll as in its travels through the virtual world using directional controls provided by the user interface 240. The user may initiate an action by the virtual doll, command the virtual doll to do something, and assist the virtual doll in a task using the user interface 240. Furthermore, the user may use the prop port 155 to send the virtual doll various props to aid or help the virtual doll complete a task or an expedition.

The virtual doll may take a journey in the virtual world. The display 220 may present multiple views of the virtual doll within the virtual world. For example, when starting a journey the view may switch from a front view (as shown in FIG. 6) of the virtual doll to an overhead view of the virtual doll. The user may direct the virtual doll using the directional controls provided by the user interface 240 to move the virtual doll through the virtual world. During the journey the virtual doll may encounter different terrains, tasks, and obstacles (e.g., a jungle maze, a river crossing, a cave, or a rope bridge). During the journey certain indicators (e.g., visual and or audio) may be used to mark special encounters within the virtual world. For example, red dots might be used to indicate heat signals emitted by all the various creatures the virtual doll may encounter in the jungle. When the virtual doll approaches an indicator, the user may position the virtual doll to take a photo. For example, the user may press a "Snap Shot Button" to produce a virtual flash on the display 220. If the user successfully captures an image, for example, the image of an animal, the image appears briefly on the display 220. Some animal's photos may be easier to capture than others.

The virtual world application may present encounters or situations that virtual doll is unable to solve without user input. Some situations or encounters may require the use of a prop to solve. The user may determine the appropriate prop and insert it in the virtual world unit 120, for example, using the prop port 155. The virtual doll recognizes the prop 115, and the virtual prop 615 may be presented on the display 220. The virtual doll may indicate if the prop is the one that is needed to complete the task or ask for another. For example, the virtual doll may indicate by simulated speech that it wants to make a phone call (e.g., "Hey, let's call my best friend.") The user may insert a cell phone prop into the prop port. The processing device 210 receives a signal from the detector that the cell phone prop is in the prop port. The processing device 210 generates a screen on the display 220 causing the cell phone to appear and used by the virtual doll. The virtual doll may then simulate making a phone call including audio sound effects such as ringing. If the wrong prop is inserted the virtual doll may indicate that another props is need (e.g., "Silly, that's a camera not a cell phone.") Similarly, the virtual doll may indicate that it wants to take a picture. The user removes the cell phone prop and inserts a camera prop. The virtual doll then indicates that the user to should snap a picture (e.g., by activating a button on the user interface 240).

The virtual doll also may engage in games with the user. For example, the display 220 may present a maze that the virtual doll has to navigate. The user may be directed to use directional controls to navigate the maze. The screen may present the maze and an indication of the virtual doll's position within the maze. The screen may present an animated sequence if the maze is successfully navigated. Other games also may be presented. For example, the user may take a photo safari in which the virtual doll has to take pictures of specified animals or a specified number of animals. The display 220 may present an indication of the number of pictures taken and number remaining. In addition, a time limit may be imposed. Also, the skill level of the game may be changed to increase or decrease the difficulty of the game based on the user's ability.

A number of exemplary implementations have been described. Nevertheless, it will be understood that various modifications may be made. For example, suitable results may be achieved if the steps of described techniques are performed in a different order and/or if components in a described components, architecture, or devices are combined in a different manner and/or replaced or supplemented by other components. Accordingly, other implementations are within the scope of the following claims.

What is claimed is:

1. A virtual world toy system comprising:

a physical doll;

a virtual world unit including:

a housing;

a receptacle configured to receive the physical doll;

a display configured to present a virtual representation of the physical doll in a virtual world;

a processing device configured to determine that the physical doll is in the doll receptacle and to generate the virtual representation on the display in response to the determination, wherein the display is positioned substantially in a first plane and the doll receptacle is positioned substantially in a second plane that is substantially parallel to the first plane and the receptacle is configured to move in and out of the housing along the second plane; the display is positioned adjacent to the doll receptacle and is configured to block the view of a user of a portion of the doll and an interior portion of the doll receptacle that is inside the housing; and the processor is configured to present on the display a virtual representation of only the portion of the doll that is blocked from view; and one or more physical props for use with the toy system, wherein the virtual world unit includes a prop receptacle to receive the one or more physical props, and the processing device is configured to determine a physical prop in the prop receptacle and to generate a virtual representation of the determined prop on the display.

2. The system of claim 1 wherein the processor is configured to present via the display a virtual world that may be navigated by the virtual representation of the doll.

3. The system of claim 1 wherein the virtual world unit further includes a detection device to detect the physical doll in the doll receptacle.

4. The system of claim 1 wherein the virtual world unit further includes a detection device to detect the physical prop in the prop receptacle.

5. The system of claim 1 wherein the physical doll includes an identification device configured to be read by the virtual world unit to identify the physical doll and the processor is configured to generate a virtual representation of the physical doll based on the identification.

6. The system of claim 1 wherein the physical doll includes a memory to store data about its corresponding virtual representation's interaction with the virtual world.

7. The system of claim 1 wherein the physical doll includes a memory to store data about the physical doll's interaction with the virtual world.

8. The system of claim 1 wherein the virtual world unit includes a memory to store a virtual world application that is used by the processing device to present the virtual world.

9. The system of claim 1 wherein the virtual world unit includes a memory to store data about the virtual representation's interaction with the virtual world.

10. The system of claim 1 wherein the virtual world unit includes a memory to store data about the physical doll's interaction with the virtual world unit.

11. The system of claim 1 wherein the virtual world unit further comprises a user interface to provide signals to the processing device to navigate the virtual representation of the doll within the virtual world.

12. The system of claim 1 wherein the processor is configured to present a game to a user using the display that be played in conjunction with the virtual representation of the doll.

13. The system of claim 1 wherein the virtual world unit further includes an interface to connect to another virtual world unit.

14. The system of claim 1 wherein the housing is configured to completely receive the receptacle once moved into the housing along the second plane; the receptacle is configured to hold the entire doll and when the receptacle is completely placed inside the housing to visually block the entire doll; and the processor is further configured to present a virtual representation of the entire doll on the display.

15. The unit of claim 1 wherein the receptacle configured to receive and hold the physical doll in its entirety.

16. A virtual world unit comprising:

a housing;

a receptacle configured to receive a physical doll;

a display configured to present a virtual representation of the physical doll in a virtual world;

a processing device configured to determine that the physical doll is in the doll receptacle and to generate the virtual representation on the display in response to the determination, wherein the display is positioned substantially in a first plane and the doll receptacle is positioned substantially in a second plane that is substantially parallel to the first plane and the receptacle is configured to move in and out of the housing along the second plane; the display is positioned adjacent to the doll receptacle and is configured to block the view of a user of a portion of the doll and an interior portion of the doll receptacle that is inside the housing; and the processor is configured to present on the display a virtual representation of only the portion of the doll that is blocked from view; and a prop receptacle to receive one or more physical props, wherein the processing device is configured to determine a physical prop in the prop receptacle and to generate a virtual representation of the determined prop on the display.

17. The unit of claim 16 wherein the processor is configured to present via the display a virtual world that may be navigated by the virtual representation of the doll.

18. The unit of claim 17 further comprising a detection device to detect a physical doll in the doll receptacle.

19. The unit of claim 16 further comprising a detection device to detect a physical prop in the prop receptacle.

20. The unit of claim 17 wherein the detection device is configured to read an identification device of the physical doll to identify the physical doll and the processor is configured to generate a virtual representation of the physical doll based on the identification.

21. The unit of claim 16 wherein the processor is configured to provide data to a memory of the physical doll to store data about its corresponding virtual representation's interaction with the virtual world.

22. The unit of claim 16 wherein the virtual world unit includes a memory to store a virtual world application that is used by the processing device to present the virtual world.

23. The system of claim 16 wherein the virtual world unit includes a memory to store data about the virtual representation's interaction with the virtual world.

24. The system of claim 16 wherein the virtual world unit includes a memory to store data about the physical doll's interaction with the virtual world unit.

25. The system of claim 16 wherein the virtual world unit further comprises a user interface to provide signals to the processing device to navigate the virtual representation of the doll within the virtual world.

26. The system of claim 16 wherein the processor is configured to present a game to a user using the display that be played in conjunction with the virtual representation of the doll.

27. The system of claim 16 wherein the virtual world unit further includes an interface to connect to another virtual world unit.

28. The unit of claim 16 wherein the housing is configured to completely receive the receptacle once moved into the housing along the second plane; the receptacle is configured to hold the entire doll and when the receptacle is completely placed inside the housing to visually block the entire doll; and the processor is further configured to present a virtual representation of the entire doll on the display.

29. The unit of claim 16 wherein the receptacle configured to receive and hold the physical doll in its entirety.

* * * * *